US007669674B2

(12) United States Patent
Hall et al.

(10) Patent No.: US 7,669,674 B2
(45) Date of Patent: Mar. 2, 2010

(54) DEGRADATION ASSEMBLY

(76) Inventors: David R. Hall, 2185 S. Larsen Pkwy., Provo, UT (US) 84606; Ronald Crockett, 2185 S. Larsen Pkwy., Provo, UT (US) 84606; Scott Dahlgren, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 12/051,738

(22) Filed: Mar. 19, 2008

(65) Prior Publication Data

US 2008/0164073 A1 Jul. 10, 2008

Related U.S. Application Data

(63) Continuation of application No. 12/051,689, filed on Mar. 19, 2008, which is a continuation of application No. 12/051,586, filed on Mar. 19, 2008, which is a continuation-in-part of application No. 12/021,051, filed on Jan. 28, 2008, which is a continuation-in-part of application No. 12/021,019, filed on Jan. 28, 2008, which is a continuation-in-part of application No. 11/971,965, filed on Jan. 10, 2008, which is a continuation of application No. 11/947,644, filed on Nov. 29, 2007, which is a continuation-in-part of application No. 11/844,586, filed on Aug. 24, 2007, now Pat. No. 7,600,823, which is a continuation-in-part of application No. 11/829,761, filed on Jul. 27, 2007, which is a continuation-in-part of application No. 11/773,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, said application No. 12/021,051 is a continuation-in-part of application No. 11/965,672, filed on Dec. 27, 2007, which is a continuation-in-part of application No. 11/686,831, filed on Mar. 15, 2007, now Pat. No. 7,568,770.

(51) Int. Cl.
*E21B 10/46* (2006.01)

(52) U.S. Cl. ..... 175/434; 175/435; 175/430

(58) Field of Classification Search ..... 175/426, 175/428, 430, 434, 435, 432
See application file for complete search history.

(56) References Cited

U.S. PATENT DOCUMENTS 2,004,315 A 6/1935 Fean (Continued)

*Primary Examiner*—John Kreck
(74) *Attorney, Agent, or Firm*—Tyson J. Wilde

(57) ABSTRACT

In one aspect of the invention, a tool has a working portion with at least one impact tip brazed to a carbide extension. The carbide extension has a cavity formed in a base end and is adapted to interlock with a shank assembly of the cutting element assembly. The shank assembly has a locking mechanism adapted to interlock a first end of the shank assembly within the cavity. The locking mechanism has a radially extending catch formed in the first end of the shank assembly. The shank assembly has an outer surface at a second end of the shank assembly adapted to be press-fitted within a recess of a driving mechanism. The outer surface of the shank assembly has a coefficient of thermal expansion of 110 percent or more than a coefficient of thermal expansion of a material of the driving mechanism.

19 Claims, 11 Drawing Sheets

U.S. PATENT DOCUMENTS 2,124,438 A 7/1938 Struk
3,254,392 A 6/1966 Novkov
3,746,396 A 7/1973 Radd
3,807,804 A 4/1974 Kniff
3,830,321 A 8/1974 McKenry
3,932,952 A 1/1976 Helton
3,945,681 A 3/1976 White
4,005,914 A 2/1977 Newman
4,006,936 A 2/1977 Crabiel
4,098,362 A 7/1978 Bonnice
4,109,737 A 8/1978 Bovenkerk
4,156,329 A 5/1979 Daniels
4,199,035 A 4/1980 Thompson
4,201,421 A 5/1980 Den Besten
4,277,106 A 7/1981 Sahley
4,439,250 A 3/1984 Acharya
4,465,221 A 8/1984 Acharya
4,484,644 A 11/1984 Cook
4,489,986 A 12/1984 Dziak
4,678,237 A 7/1987 Collin
4,682,987 A 7/1987 Brady
4,688,856 A 8/1987 Elfgen
4,694,918 A 9/1987 Hall
4,725,098 A 2/1988 Beach
4,729,603 A 3/1988 Elfgen
4,765,686 A 8/1988 Adams
4,765,687 A 8/1988 Parrott
4,776,862 A 10/1988 Wiand
4,880,154 A 11/1989 Tank
4,932,723 A 6/1990 Mills
4,940,288 A 7/1990 Stiffler
4,944,559 A 7/1990 Sionnet
4,951,762 A 8/1990 Lundell
5,011,515 A 4/1991 Frushour
5,112,165 A 5/1992 Hedlund
5,119,714 A * 6/1992 Scott et al. ..... 76/108.2
5,141,289 A 8/1992 Stiffler
5,154,245 A 10/1992 Waldenstrom
5,186,692 A 2/1993 Pope
5,251,964 A 10/1993 Ojanen
5,261,499 A 11/1993 Grubb
5,332,348 A 7/1994 Lemelson
5,417,475 A 5/1995 Graham
5,447,208 A 9/1995 Lund
5,535,839 A 7/1996 Brady
5,542,993 A 8/1996 Rabinkin
5,653,300 A 8/1997 Lund
5,662,720 A * 9/1997 O'Tighearnaigh ..... 51/295
5,738,698 A 4/1998 Kapoor
5,823,632 A 10/1998 Burkett
5,837,071 A 11/1998 Anderson
5,845,547 A 12/1998 Sollami
5,875,862 A 3/1999 Jurewicz
5,890,552 A * 4/1999 Scott et al. ..... 175/426
5,934,542 A 8/1999 Nakamura
5,935,718 A 8/1999 Demo
5,944,129 A 8/1999 Jensen
5,967,250 A 10/1999 Lund
5,992,405 A 11/1999 Sollami
6,000,483 A * 12/1999 Jurewicz et al. ..... 175/428
6,006,846 A 12/1999 Tibbitts
6,019,434 A 2/2000 Emmerich
6,044,920 A 4/2000 Massa
6,051,079 A 4/2000 Andersson
6,056,911 A 5/2000 Griffin
6,065,552 A 5/2000 Scott
6,113,195 A 9/2000 Mercier
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,270,165 B1 8/2001 Peay
6,341,823 B1 1/2002 Sollami
6,354,771 B1 3/2002 Bauschulte
6,364,420 B1 4/2002 Sollami
6,371,567 B1 4/2002 Sollami
6,375,272 B1 4/2002 Ojanen
6,419,278 B1 7/2002 Cunningham
6,460,637 B1 * 10/2002 Siracki et al. ..... 175/430
6,478,383 B1 11/2002 Ojanen
6,499,547 B2 12/2002 Scott
6,517,902 B2 2/2003 Drake
6,585,326 B2 7/2003 Sollami
6,601,662 B2 * 8/2003 Matthias et al. ..... 175/374
6,685,273 B1 2/2004 Sollami
6,709,065 B2 3/2004 Peay
6,719,074 B2 4/2004 Tsuda
6,733,087 B2 5/2004 Hall
6,739,327 B2 5/2004 Sollami
6,758,530 B2 7/2004 Sollami
6,786,557 B2 9/2004 Montgomery, Jr.
6,824,225 B2 11/2004 Stiffler
6,651,758 B2 2/2005 Beach
6,854,810 B2 2/2005 Montgomery, Jr.
6,861,137 B2 3/2005 Griffin
6,889,890 B2 5/2005 Yamazaki
6,966,611 B1 11/2005 Sollami
6,994,404 B1 2/2006 Sollami
7,204,560 B2 4/2007 Mercier
2002/0175555 A1 11/2002 Mercier
2003/0140350 A1 7/2003 Noro
2003/0209366 A1 11/2003 McAlvain
2003/0234280 A1 12/2003 Cadden
2004/0026983 A1 2/2004 McAlvain
2004/0065484 A1 4/2004 McAlvain
2005/0159840 A1 7/2005 Lin
2005/0173966 A1 8/2005 Mouthaan
2006/0237236 A1 10/2006 Sreshia

* cited by examiner

DEGRADATION ASSEMBLY

This application is a continuation of U.S. patent application Ser. No. 12/051,689 filed Mar. 19, 1998 which is a continuation of U.S. patent application Ser. No. 12/051,586 filed Mar. 19, 1998 which is a continuation-in-part of U.S. patent application Ser. No. 12/021,051 filed Jan. 28, 1998 which is a continuation-in-part of U.S. patent application Ser. No. 12/021,019 filed Jan. 28, 1998 which was a continuation-in-part of U.S. patent application Ser. No. 11/971,965 filed Jan. 10, 2008 which is a continuation of U.S. patent application Ser. No. 11/947,644, filed Nov. 29, 2007 which was a continuation-in-part of U.S. patent application Ser. No. 11/844,586 filed Aug. 24, 20007 now U.S. Pat. No 7,600,823. U.S. patent application Ser. No. 11/844,586 is a continuation-in-part of U.S. patent application Ser. No. 11/829,761 filed Jul. 27, 2008. U.S. patent application Ser. No. 11/829,761 is a continuation-in-part of U.S. patent application Ser. No. 11/773,271 filed Jul. 03, 2007. U.S. patent application Ser. No. 11/773,271 is a continuation-in-part of U.S. patent application Ser. No. 11/766,903 filed Jul. 22, 2007. U.S. patent application Ser. No. 11/766,903 is a continuation of U.S. patent application Ser. No. 11/766,865 filed Jun. 22, 2007. U.S. patent application Ser. No. 11/766,865 is a continuation-in-part of U.S. patent application Ser. No. 11/742,304 filed Apr. 30, 2007 now U.S. Pat No. 7,475,948. U.S. patent application Ser. No. 11/742,304 is a continuation of U.S. patent application Ser. No. 11/742,261 filed Apr. 30, 2007 now U.S. Pat. No. 7,469,971. U.S. patent application Ser. No. 11/742,261 is a continuation-in-part of U.S. patent application Ser. No. 11/464,008 filed Aug. 11, 2006 now U.S. Pat. No. 7,338,135. U.S. patent application Ser. No. 11/464,008 is a continuation-in-part of U.S. patent application Ser. No. 11/463,998 filed Aug. 11, 2006 now U.S. Pat. No. 7,384,105. U.S. patent application Ser. No. 11/463,998 is a continuation-in-part of U.S. patent application Ser. No. 11/463,990 filed Aug. 11, 2006 now U.S. Pat. No. 7,320,505. U.S. patent application Ser. No. 11/463,990 is a continuation-in-part of U.S. patent application Ser. No. 11/463,975 filed Aug. 11, 2006 now U.S. Pat. No. 7,445,294. U.S. patent application Ser. No. 11/463,975 is a continuation-in-part of U.S. patent application Ser. No. 11/463,962 filed Aug. 11, 2006 now U.S. Pat. No. 7,413,256. U.S. patent application Ser. No. 11/463,962 is a continuation-in-part of U.S. patent application Ser. No. 11/463,953 filed Aug. 11, 2006 now U.S. Pat. No 7,464,993. The present application is also a continuation-in-part of U.S. patent application Ser. No. 11/695,672 filed Dec. 27, 2007. U.S. patent application Ser. No. 11/695,672 is a continuation-in-part of U.S. patent application Ser. No. 11/686,831 filed Mar. 15, 2007 now U.S. Pat. No. 7,568,770. All of these applications are herein incorporated by reference for all that they contain.

BACKGROUND OF THE INVENTION

This invention relates to drill bits, specifically drill bit assemblies for use in oil, gas and geothermal drilling. More particularly, the invention relates to cutting elements in drill bits comprised of a carbide substrate with an abrasion resistant layer of superhard material.

Such cutting elements are often subjected to intense forces, torques, vibration, high temperatures and temperature differentials during operation. As a result, stresses within the structure may begin to form. Drag bits for example may exhibit stresses aggravated by drilling anomalies during well boring operations such as bit whirl or bounce often resulting in spalling, delamination or fracture of the superhard abrasive layer or the substrate thereby reducing or eliminating the cutting elements efficacy and decreasing overall drill bit wear life. The superhard material layer of a cutting element sometimes delaminates from the carbide substrate after the sintering process as well as during percussive and abrasive use. Damage typically found in drag bits may be a result of shear failures, although non-shear modes of failure are not uncommon. The interface between the super hard material layer and substrate is particularly susceptible to non-shear failure modes due to inherent residual stresses.

U.S. Pat. No. 6,332,503 by Pessier et al, which is herein incorporated by reference for all that it contains, discloses an array of chisel-shaped cutting elements are mounted to the face of a fixed cutter bit. Each cutting element has a crest and an axis which is inclined relative to the borehole bottom. The chisel-shaped cutting elements may be arranged on a selected portion of the bit, such as the center of the bit, or across the entire cutting surface. In addition, the crest on the cutting elements may be oriented generally parallel or perpendicular to the borehole bottom.

U.S. Pat. No. 6,408,959 by Bertagnolli et al., which is herein incorporated by reference for all that it contains, discloses a cutting element, insert or compact which is provided for use with drills used in the drilling and boring of subterranean formations.

U.S. Pat. No. 6,484,826 by Anderson et al., which is herein incorporated by reference for all that it contains, discloses enhanced inserts formed having a cylindrical grip and a protrusion extending from the grip.

U.S. Pat. No. 5,848,657 by Flood et al, which is herein incorporated by reference for all that it contains, discloses domed polycrystalline diamond cutting element wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material disposed over said distal end portion such that an annulus of metal carbide adjacent and above said drill bit is not covered by said abrasive material layer.

U.S. Pat. No. 4,109,737 by Bovenkerk which is herein incorporated by reference for all that it contains, discloses a rotary bit for rock drilling comprising a plurality of cutting elements mounted by interence-fit in recesses in the crown of the drill bit. Each cutting element comprises an elongated pin with a thin layer of polycrystalline diamond bonded to the free end of the pin.

US patent Application Ser. No. 2001/0004946 by Jensen, although now abandoned, is herein incorporated by reference for all that it discloses. Jensen teaches that a cutting element or insert with improved wear characteristics while maximizing the manufacturability and cost effectiveness of the insert. This insert employs a superabrasive diamond layer of increased depth and by making use of a diamond layer surface that is generally convex.

BRIEF SUMMARY OF THE INVENTION

In one aspect of the invention, a degradation assembly has a working portion with at least one impact tip brazed to a carbide extension. The carbide extension has a cavity formed in a base end and is adapted to interlock with a shank assembly of the cutting element assembly. The shank assembly has a locking mechanism adapted to interlock a first end of the shank assembly within the cavity. The locking mechanism has a radially extending catch formed in the first end of the shank assembly. The shank assembly has an outer surface at a second end of the shank assembly adapted to be press-fitted within a recess of a driving mechanism. The outer surface of the shank assembly has a coefficient of thermal expansion of 110 percent or more than a coefficient of thermal expansion of a material of the driving mechanism.

The cavity may have an inwardly protruding catch. The inwardly protruding catch may be adapted to interlock with the radially extending catch. An insert may be intermediate the inwardly protruding catch and the radially extending catch. The insert may be a ring, a snap ring, a split ring, or a flexible ring. The insert may also be a plurality of balls, wedges, shims or combinations thereof. The insert may be a spring.

The locking mechanism may have a locking shaft extending from the first end of the shank assembly towards the second end of the shank assembly. The locking mechanism of the shank assembly may be mechanically connected to the outer surface of the shank assembly. Mechanically connecting the locking mechanism to the outer surface may apply tension along a length of the locking shaft. The locking mechanism may have a coefficient of thermal expansion equal to or less than the coefficient of thermal expansion of the outer surface. The shank assembly may comprise steel.

The tip may comprise a superhard material bonded to a cemented metal carbide substrate at a non-planar interface. The cemented metal carbide substrate may be brazed to the carbide extension. The cemented metal carbide substrate may have the same coefficient of thermal expansion as the carbide extension. The cemented metal carbide substrate may have a thickness of 0.30 to 0.65 times a thickness of the superhard material. At least two impact tips may be brazed to the carbide extension The assembly may be incorporated in drill bits, shear bits, percussion bits, roller cone bits or combinations thereof. The assembly may be incorporated in mining picks, trenching picks, asphalt picks, excavating picks or combinations thereof. The carbide extension may comprise a drill bit blade, a drill bit working surface, a pick bolster, or combinations thereof.

DETAILED DESCRIPTION OF THE INVENTION AND THE PREFERRED EMBODIMENT

Figure 1:
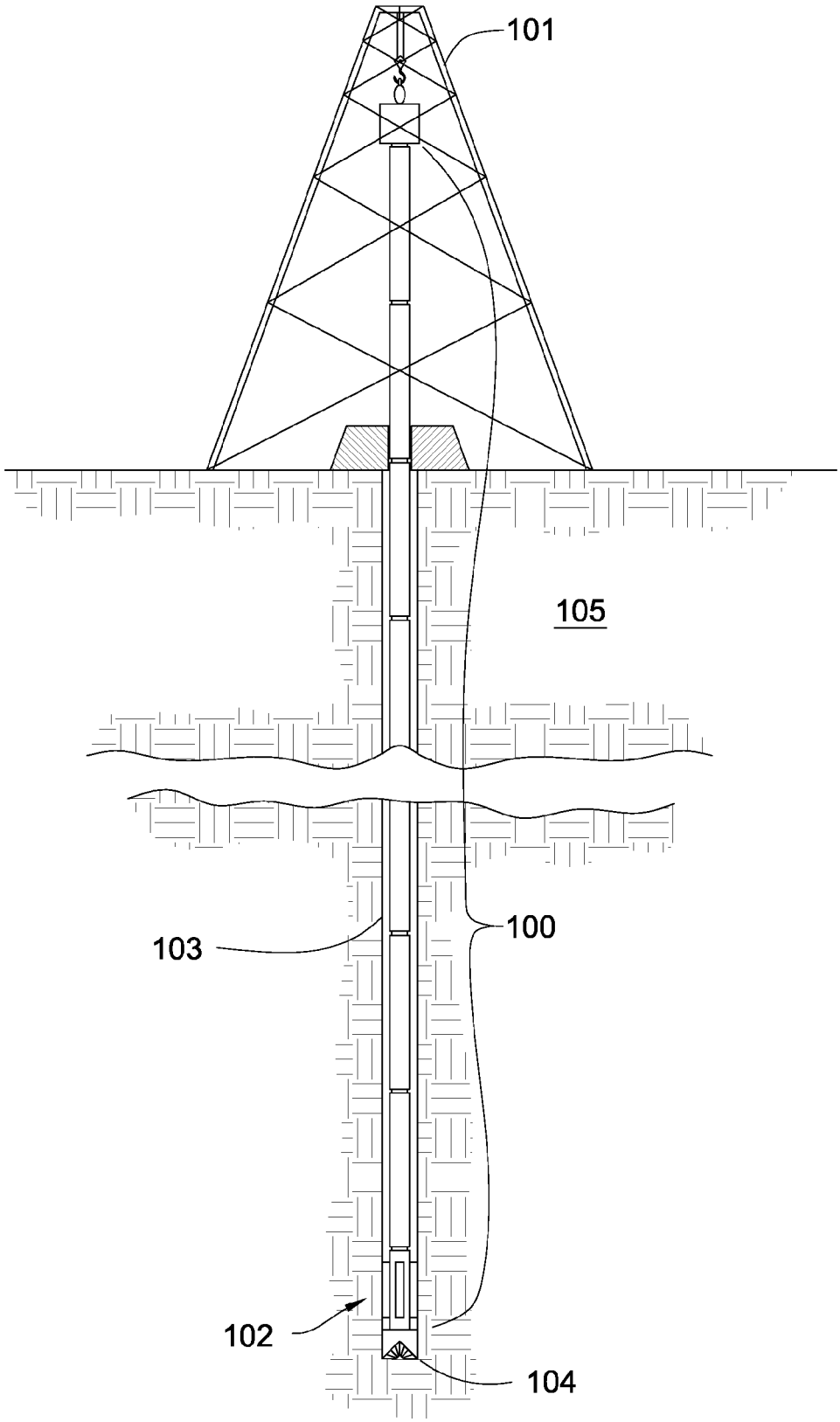
FIG. 1 is a perspective diagram of an embodiment of a drill string suspended in a bore hole.

Referring now to the figures, FIG. 1 is a cross-sectional diagram of an embodiment of a drill string 100 suspended by a derrick 101. A bottom-hole assembly 102 is located at the bottom of a bore hole 103 and comprises a bit 104 and a stabilizer assembly. As the drill bit 104 rotates down hole the drill string 100 advances farther into the earth. The drill string 100 may penetrate soft or hard subterranean formations 105.

Figure 2:
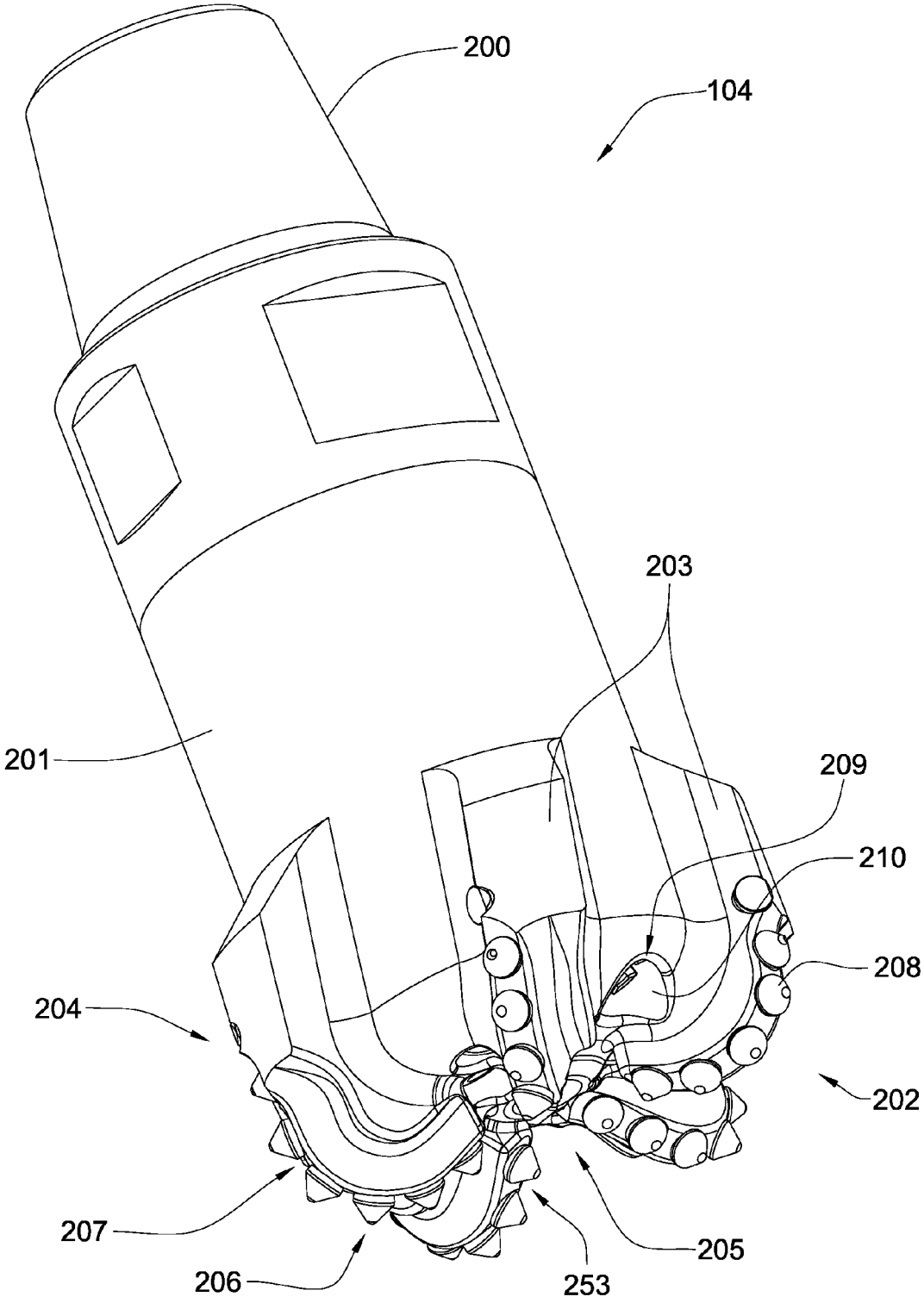
FIG. 2 is a perspective diagram of an embodiment of a rotary drag bit.

FIG. 2 discloses an embodiment wherein the drill bit 104 may be a rotary drag bit. The drill bit 104 comprises a shank 200 which is adapted for connection to the drill string 100. In some embodiments coiled tubing or other types of tool string 100 may be used. The drill bit 104 of the present invention is intended for deep oil and gas drilling, although any type of drilling application is anticipated such as horizontal drilling, geothermal drilling, mining, exploration, on and off-shore drilling, directional drilling, water well drilling and any combination thereof. The bit body 201 is attached to the shank 200 and comprises an end which forms a working face 202. Several blades 203 extend outwardly from the bit body 201, each of which may comprise a plurality of cutting inserts 208. A drill bit 104 most suitable for the present invention may have at least three blades 203; preferably the drill bit 104 will have between three and seven blades 203. The blades 203 collectively form an inverted conical region 205. Each blade 203 may have a cone portion 253, a nose portion 206, a flank portion 207, and a gauge portion 204. Cutting inserts 208 may be arrayed along any portion of the blades 203, including the cone portion 253, nose portion 206, flank portion 207, and gauge portion 204. A plurality of nozzles 209 are fitted into recesses 210 formed in the working face 202. Each nozzle 209 may be oriented such that a jet of drilling mud ejected from the nozzles 209 engages the formation before or after the cutting elements 208. The jets of drilling mud may also be used to clean cuttings away from drill bit 104. In some embodiments, the jets may be used to create a sucking effect to remove drill bit cuttings adjacent the cutting inserts 208 by creating a low pressure region within their vicinities.

Figure 3:
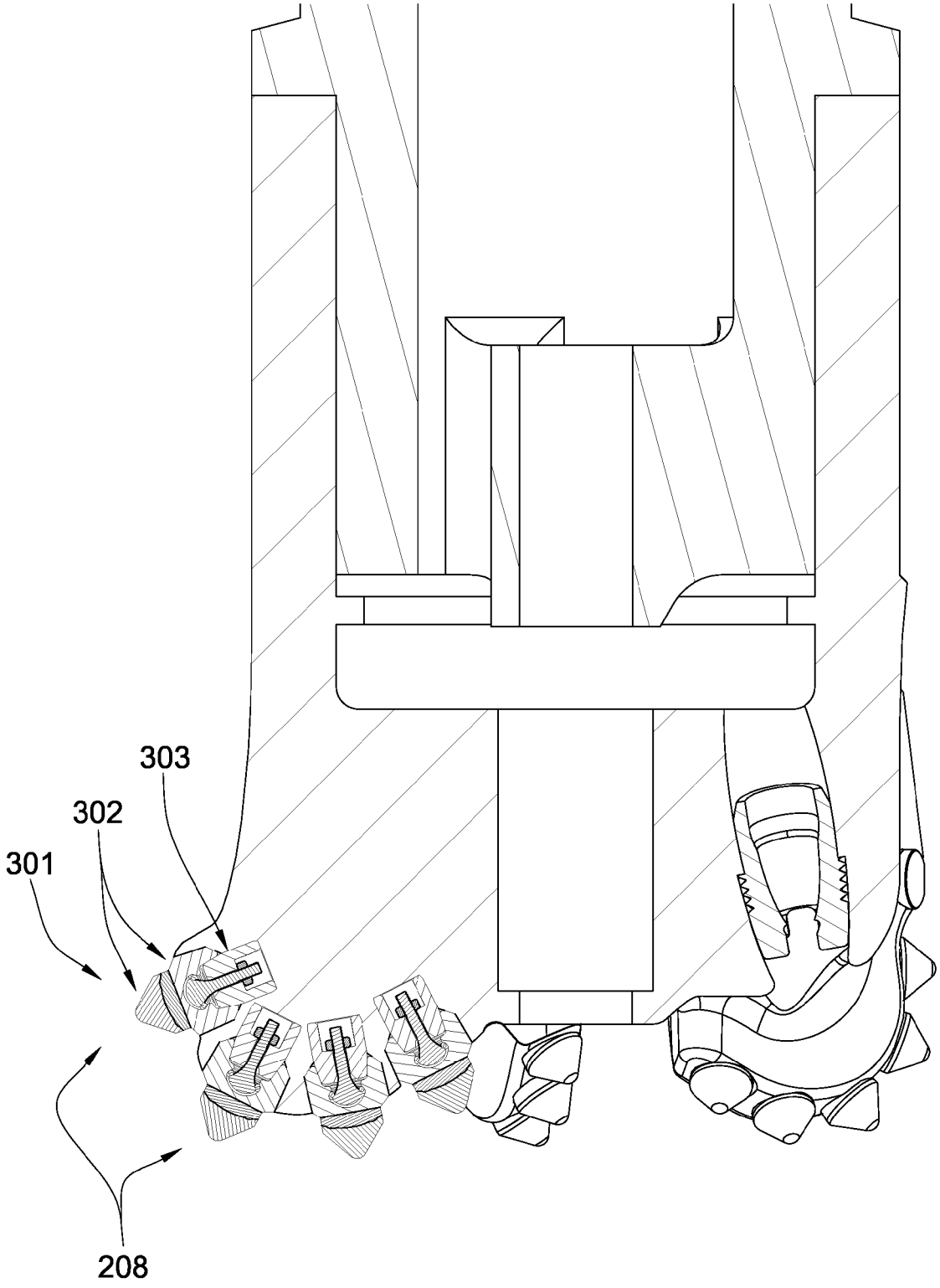
FIG. 3 is a cross-sectional diagram of another embodiment of a rotary drag bit.
Figure 4:
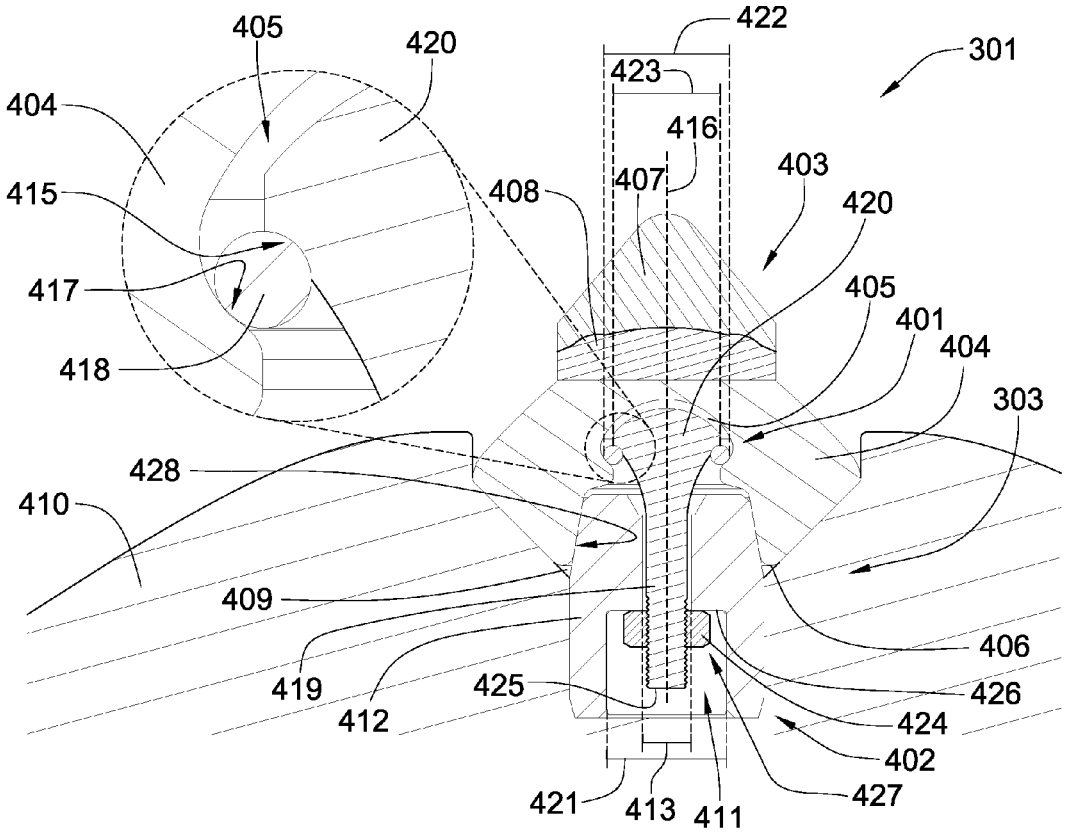
FIG. 4 is a cross-sectional diagram of an embodiment of a degradation assembly.

Referring now to FIGS. 3 though 4, the cutting insert 208 may be a degradation assembly 301. The degradation assembly 301 comprises a working portion 302 and a shank assembly 303 comprising a first end 401 and a second end 402. The working portion 302 may comprise an impact tip 403 that is brazed to a cemented metal carbide extension 404. The carbide extension 404 is adapted to interlock with the shank assembly 303. The first end 401 of the shank assembly 303 may be adapted to fit into a cavity 405 formed in a base end 406 of the carbide extension 404. A superhard material 407 may be bonded to a cemented metal carbide substrate 408 to form the impact tip 403, which may then be bonded to the carbide extension 404 opposite a base end 406 of the carbide extension 404 and opposite the first end 401 of the shank assembly 303. In FIG. 4 the shank assembly 303 is generally cylindrical. The second end 402 of the shank assembly 303 is press-fitted into a recess 409 of a driving mechanism 410. The drill bit blade 203 or bit body 201 may comprise the driving mechanism 410.

The shank assembly 303 may comprise a hard material such as steel, stainless steel, hardened steel, or other materials of similar hardness. The carbide extension 404 may comprise tungsten, titanium, tantalum, molybdenum, niobium, cobalt and/or combinations thereof.

The shank assembly 303 may be work-hardened or cold-worked in order to provide resistance to cracking or stress fractures due to forces exerted on the degradation assembly 301 by the formation 105. The shank assembly 303 may be work-hardened by shot-peening or by other methods of work-hardening. At least a portion of the shank assembly 303 may also be work-hardened by stretching it during the manufacturing process.

The shank assembly 303 comprises a locking mechanism 411 and an outer surface 412. The locking mechanism 411 is axially disposed within a bore 413 of the outer surface 412 and the second end 402 of the locking mechanism 411 is secured within or below the bore 413. The first end 401 of the locking mechanism 411 protrudes into the cavity 405 in the base end 406 of the carbide extension 404 and the first end 401 of the outer surface 412 may be adapted to fit into the cavity 405 in the base end 406 of the carbide extension 404. The locking mechanism 411 is adapted to lock the first end 401 of the shank assembly 303 within the cavity 405. The locking mechanism 411 may attach the shank assembly 303 to the carbide extension 404 and restrict movement of the shank assembly 303 with respect to the carbide extension 404. The locking mechanism 411 comprises a radially extending catch 415 that is formed in the first end 401 of the shank assembly 303. The shank assembly 303 may be prevented by the locking mechanism 411 from moving in a direction parallel to a central axis 416 of the degradation assembly 301. In some embodiments the shank assembly 303 may be prevented by the locking mechanism 411 from rotating about the central axis 416.

In FIG. 4 the cavity 405 comprises an inwardly protruding catch 417. An insert 418 is disposed intermediate the inwardly protruding catch 417 of the cavity 405 and the radially extending catch 415 of the first end 401 of the locking mechanism 411. In some embodiments the insert 418 is a flexible ring 418. In some embodiments the insert 418 may be a ring, a snap ring, a split ring, coiled ring, a flexible ring or combinations thereof In FIG. 4 the locking mechanism 411 comprises a locking shaft 419. The locking shaft 419 is connected to an expanded locking head 420. In some embodiments the radially extending catch 415 is an undercut formed in the locking head 420. The insert 418 and locking head 420 are disposed within the cavity 405 of the carbide extension 404. The locking shaft 419 protrudes from the cavity 405 and into an inner diameter 421 of the shank assembly 303. The locking shaft 419 is disposed proximate the bore 413 proximate the first end 401 of the shank assembly 303. The locking shaft 419 is adapted for translation in a direction parallel to the central axis 416 of the shank assembly 303. The locking shaft 419 may extend from the cavity 405 and the insert 418 may be inserted into the cavity 405.

When the first end 401 of the locking mechanism 411 is inserted into the cavity 405, the locking head 420 may be extended away from the bore 413 of the outer surface 412. The insert 418 may be disposed around the locking shaft 419 and be intermediate the locking head 420 and the bore 413. The insert 418 may comprise stainless steel. In some embodiments the insert 418 may comprise an elastomeric material and may be flexible. The insert 418 may be a ring, a snap ring, a split ring, a coiled ring, a rigid ring, segments, balls, wedges, shims, a spring or combinations thereof.

The insert 418 may comprise a breadth 422 that is larger than an opening 423 of the cavity 405. In such embodiments the insert 418 may compress to have a smaller breadth 422 than the opening 423. Once the insert 418 is past the opening 423, the insert 418 may expand to comprise its original or substantially original breadth 422. With both the insert 418 and the locking head 420 inside the cavity 405, the rest of the first end 401 of the shank assembly 303 may be inserted into the cavity 405 of the carbide extension 404. Once the entire first end 401 of the shank assembly 303 is inserted into the cavity 405 to a desired depth a nut 424 may be threaded onto an exposed end 425 of the locking shaft 419 until the nut 424 contacts a ledge 426 proximate the bore 413 mechanically connecting the locking mechanism 411 to the outer surface 412. This contact and further threading of the nut 424 on the locking shaft 419 may cause the locking shaft 419 to move toward the second end 402 of the shank assembly 303 in a direction parallel to the central axis 416 of the shank assembly 303. This may also result in bringing the radially extending catch 415 of the locking head 420 into contact with the insert 418, and bringing the insert 418 into contact with the inwardly protruding catch 417 of the cavity 405. The nut 424 is an embodiment of a tensioning mechanism 427. The tensioning mechanism 427 is adapted to apply a rearward force on the first end 401 of the shank assembly 303. The rearward force may pull the first end 401 of the shank assembly 303 in the direction of the second end 402 and applies tension along a length of the locking shaft 419. In some embodiments the tensioning mechanism 427 may comprise a press fit, a taper, and/or a nut 424.

Once the nut 424 is threaded tightly onto the locking shaft 419, the locking head 420 and insert 418 are together too wide to exit the opening 423. In some embodiments the contact between the locking head 420 and the carbide extension 404 via the insert 418 may be sufficient to prevent both rotation of the shank assembly 303 about its central axis 416 and movement of the shank assembly 303 in a direction parallel to its central axis 416. In some embodiments the locking mechanism 411 is also adapted to inducibly release the shank assembly 303 from attachment with the carbide extension 404 by removing the nut 424 from the locking shaft 419.

In some embodiments the insert 418 may be a snap ring. The insert 418 may comprise stainless steel and may be deformed by the pressure of the locking head 420 being pulled towards the second end 402 of the shank assembly 303. As the insert 418 deforms it may become harder. The deformation may also cause the insert 418 to be complementary to both the inwardly protruding catch 417 and the radially extending catch 415. This dually complementary insert 418 may avoid point loading or uneven loading, thereby equally distributing contact stresses. In such embodiments the insert 418 may be inserted when it is comparatively soft, and then may be work hardened while in place proximate the catches 236, 237.

In some embodiments at least part of the shank assembly 303 of the degradation assembly 301 may also be cold worked. The locking mechanism 411 may be stretched to a critical point just before the strength of the locking mechanism 411 is compromised. In some embodiments, the locking shaft 419, locking head 420, and insert 418 may all be cold worked by tightening the nut 424 until the locking shaft and head 419, 420, and the insert 418, reach a stretching critical point. During this stretching the insert 418, and the locking shaft and head 419, 420, may all deform to create a complementary engagement, and may then be hardened in that complementary engagement. In some embodiments the complementary engagement may result in an interlocking between the radially extending catch 415 and the inwardly protruding catch 417.

In the embodiment of FIG. 4, both the inwardly protruding catch 417 and the radially extending catch 415 are tapers. Also in FIG. 4, the base end 406 of the carbide extension 404 comprises a uniform inward taper 428.

Figure 5:
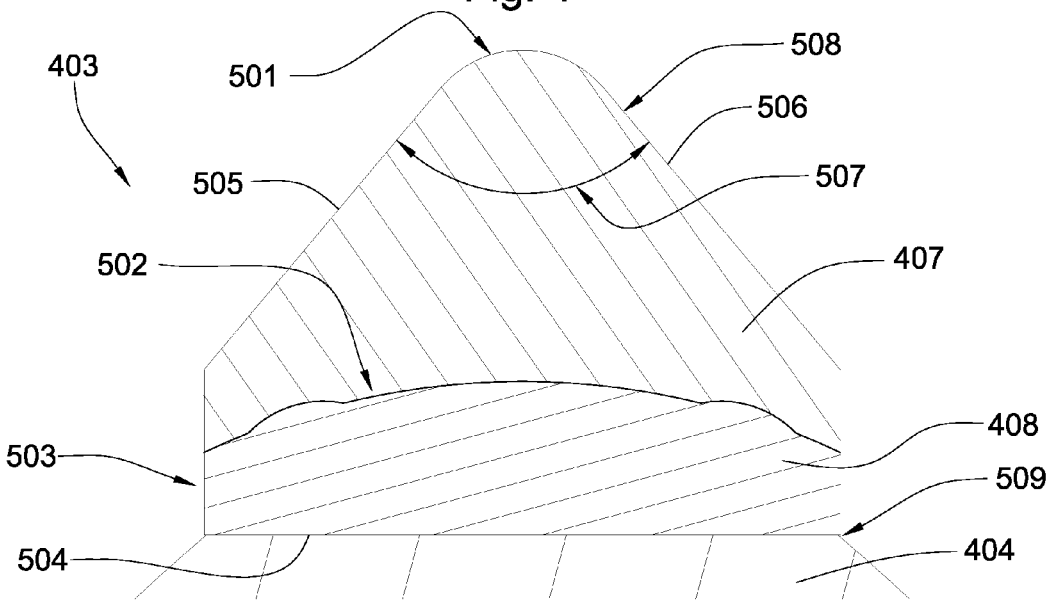
FIG. 5 is a cross-sectional diagram of an embodiment of an impact tip.

Referring now to FIG. 5, the impact tip 403 comprises the superhard material 407 bonded to the carbide substrate 408. The superhard material 407 comprises a volume greater than a volume of the carbide substrate 408. In some embodiments the superhard material 407 may comprise a volume that is 75% to 175% of a volume of the carbide substrate 408.

The superhard material 407 and comprises a substantially conical geometry with an apex 501. Preferably, the interface 502 between the substrate 408 and the superhard material 407 is non-planar, which may help distribute loads on the tip 403 across a larger area of the interface 502. At the interface 502 the substrate 408 may comprise a tapered surface starting from a cylindrical rim 503 of the substrate 408 and ending at an elevated flatted central region formed in the substrate 408. The flatted central region may have a diameter of 0.20 to 0.60 percent of a diameter of the cylindrical rim 503. A thickness from the apex 501 to the non-planar interface 502 is at least 1.5 times a thickness of the substrate 408 from the non-planar interface 502 to its base 504. In some embodiments the thickness from the apex 501 to the non-planar interface 502 may be at least 2 times a thickness of the substrate 408 from the non-planar interface to its base 504. The substrate 408 may comprise a thickness of 0.30 to 0.65 times the thickness of the superhard material 407. In some embodiments, the thickness of the substrate is less than 0.100 inches, preferably less than 0.060 inches. The thickness from the apex 501 to the non-planar interface 502 may be 0.190 to 0.290 inches. Together, the superhard material 407 and the substrate 408 may comprise a total thickness of 0.200 to 0.500 inches from the apex 501 to the base of the substrate 504. The superhard material 407 bonded to the substrate 408 may comprise a substantially conical geometry with an apex 501 comprising a 0.065 to 0.095 inch radius. The substantially conical geometry comprises a first side 505 that may form a 50 to 80 degree included angle 507 with a second side 506 of the substantially conical geometry. In asphalt milling applications, the inventors have discovered that an optimal included angle is 45 degrees, whereas in mining applications the inventors have discovered that an optimal included angle is between 35 and 40 degrees. The tip 403 may comprise an included angle 507 to the thickness from the apex 501 to the non-planar interface 502 ratio of 240 to 440. The tip 403 may comprise an included angle 507 to a total thickness from the apex 501 to a base 504 of the substrate 408 ratio of 160 to 280. A tip that maybe compatible with the present invention is disclosed in U.S. patent application Ser. No. 11/673,634 to Hall and is currently pending.

The superhard material 407 may be a material selected from the group consisting of diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof. The superhard material 407 may also comprise infiltrated diamond. The superhard material 407 may comprise an average diamond grain size of 1 to 100 microns. The superhard 407 material may comprise a monolayer of diamond. For the purpose of this patent the word monolayer is defined herein as a singular continuous layer of a material of indefinite thickness.

The superhard material 407 may comprise a metal catalyst concentration of less than 5 percent by volume. The superhard material 407 may be leached of a catalyzing material to a depth of no greater than at least 0.5 mm from a working surface 508 of the superhard material 407. A description of leaching and its benefits is disclosed in U.S. Pat. No. 6,562,462 to Griffin et al, which is herein incorporated by reference for all that it contains. Isolated pockets of catalyzing material may exist in the leached region of the superhard material 407. The depth of at least 0.1 mm from the working surface 508 may comprise a catalyzing material concentration of 5 to 1 percent by volume.

The impact tip 403 may be brazed onto the carbide extension 404 at a braze interface 509. Braze material used to braze the tip 403 to the carbide extension 404 may comprise a melting temperature from 700 to 1200 degrees Celsius; preferably the melting temperature is from 800 to 970 degrees Celsius. The braze material may comprise silver, gold, copper nickel, palladium, boron, chromium, silicon, germanium, aluminum, iron, cobalt, manganese, titanium, tin, gallium, vanadium, phosphorus, molybdenum, platinum, or combinations thereof. The braze material may comprise 30 to 62 weight percent palladium, preferable 40 to 50 weight percent palladium. Additionally, the braze material may comprise 30 to 60 weight percent nickel, and 3 to 15 weight percent silicon; preferably the braze material may comprise 47.2 weight percent nickel, 46.7 weight percent palladium, and 6.1 weight percent silicon. Active cooling during brazing may be critical in some embodiments, since the heat from brazing may leave some residual stress in the bond between the carbide substrate 408 and the superhard material 407. The farther away the superhard material 407 is from the braze interface 509, the less thermal damage is likely to occur during brazing. Increasing the distance between the brazing interface 509 and the superhard material 407, however, may increase the moment on the carbide substrate 408 and increase stresses at the brazing interface 509 upon impact. The shank assembly 303 may be press fitted into the carbide extension 404 before or after the tip 403 is brazed onto the carbide extension 404.

Figure 6:
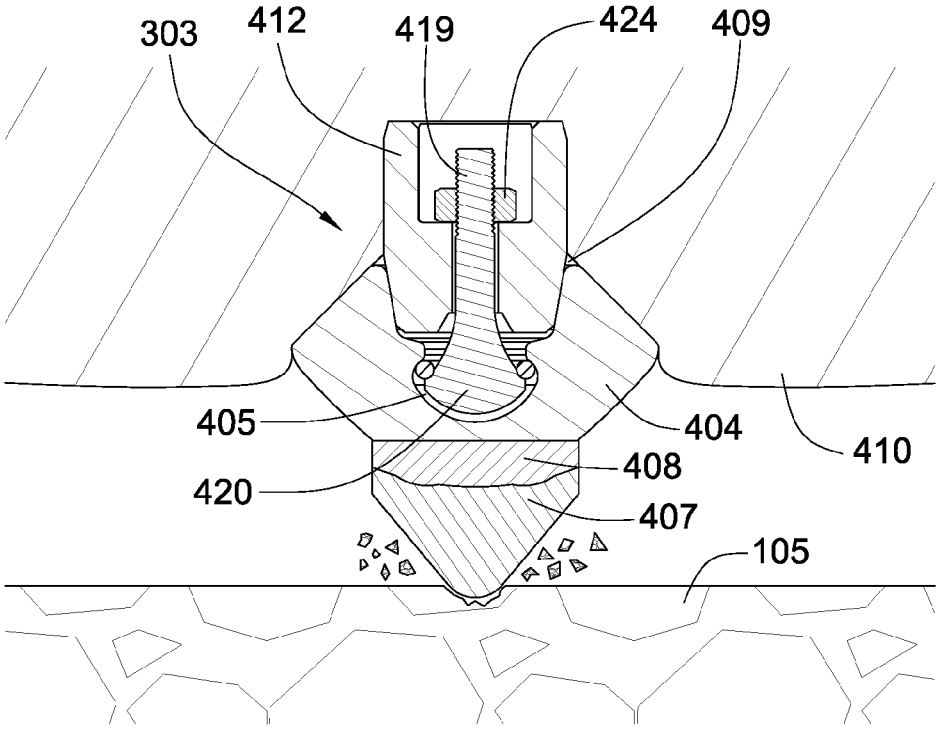
FIG. 6 is a cross-sectional diagram of another embodiment of a degradation assembly.
Figure 7:
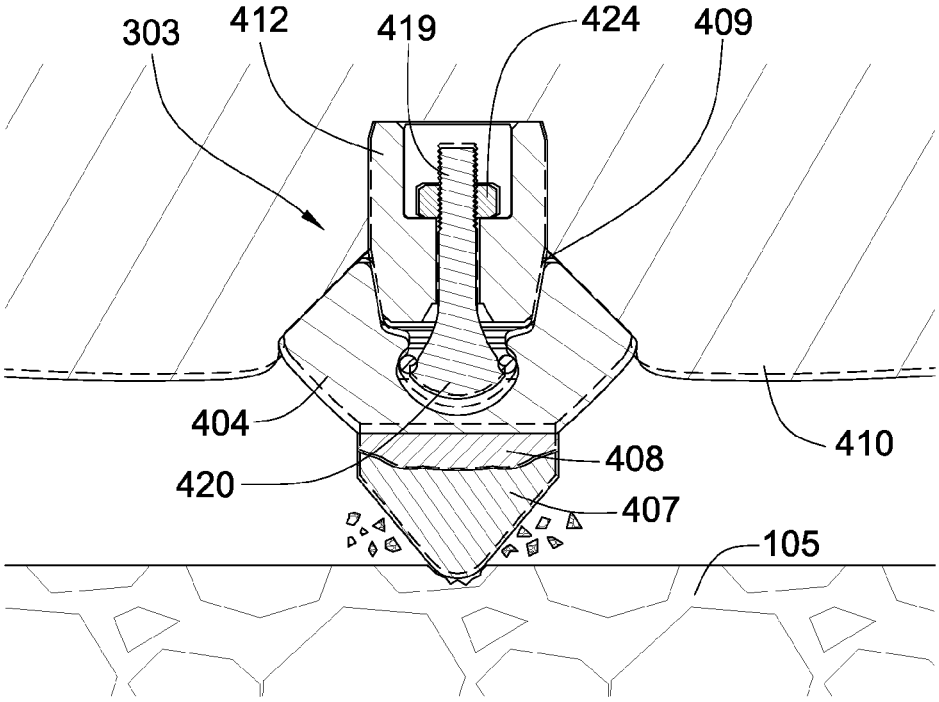
FIG. 7 is a cross-sectional diagram of another embodiment of a degradation assembly.

Referring now to FIGS. 6 through 7, the outer surface 412 of the shank assembly 303 may be press-fit into the recess 409 formed in the driving mechanism 410. The outer surface 412 of the shank assembly 303 has a coefficient of thermal expansion within 25 percent of a coefficient of thermal expansion of a material of the driving mechanism 410. It is believed that if the coefficient of thermal expansion of the outer surface 412 within 25 percent the coefficient of thermal expansion of the driving mechanism 410 that the press-fit connection between the outer surface 412 and the driving mechanism 410 will not be compromised as the driving mechanism 410 increases in temperature due to friction or working conditions. In the preferred embodiment, the coefficients of thermal expansion are within 10 percent. The locking mechanism 411 may comprise a coefficient of thermal expansion equal to or less than the coefficient of thermal expansion of the outer surface 412. It is believed that if the coefficients of thermal expansion are outside of 25 percent that the shank assemblies 303 will loose their press fit and potentially fall out of the driving mechanism. The benefits of similar coefficients allow for a more optimized press fit. The carbide substrate 408 may have the same coefficient of thermal expansion as the carbide extension 404.

Figure 8:
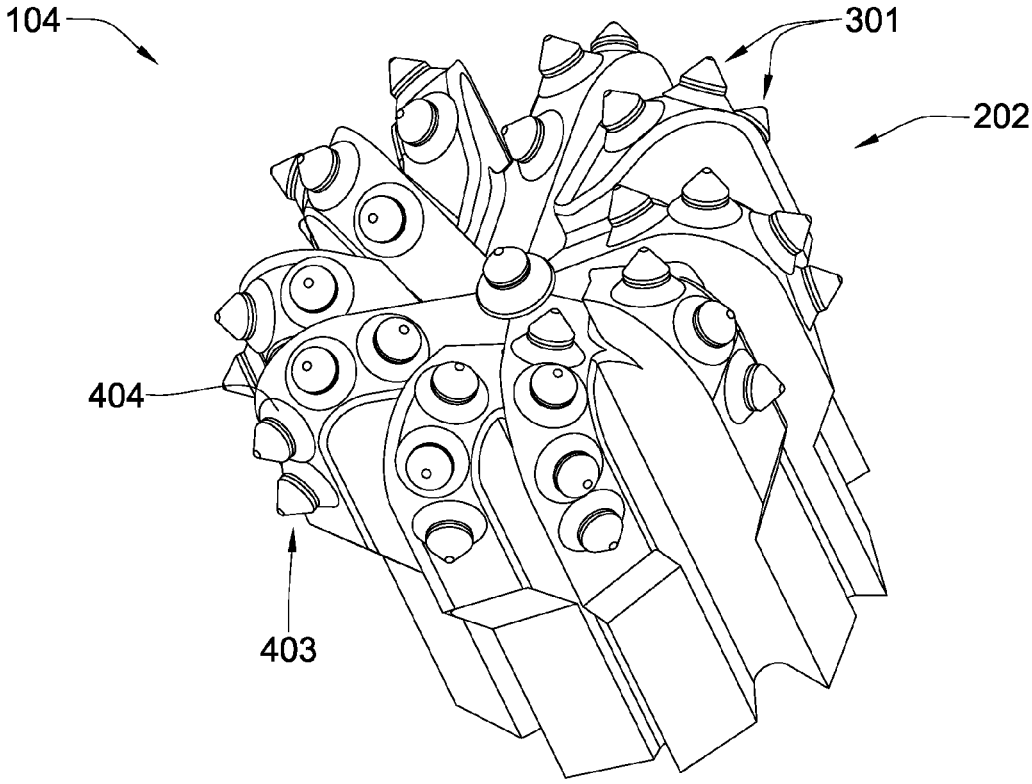
FIG. 8 is a perspective diagram of another embodiment of a rotary drag bit.
Figure 9:
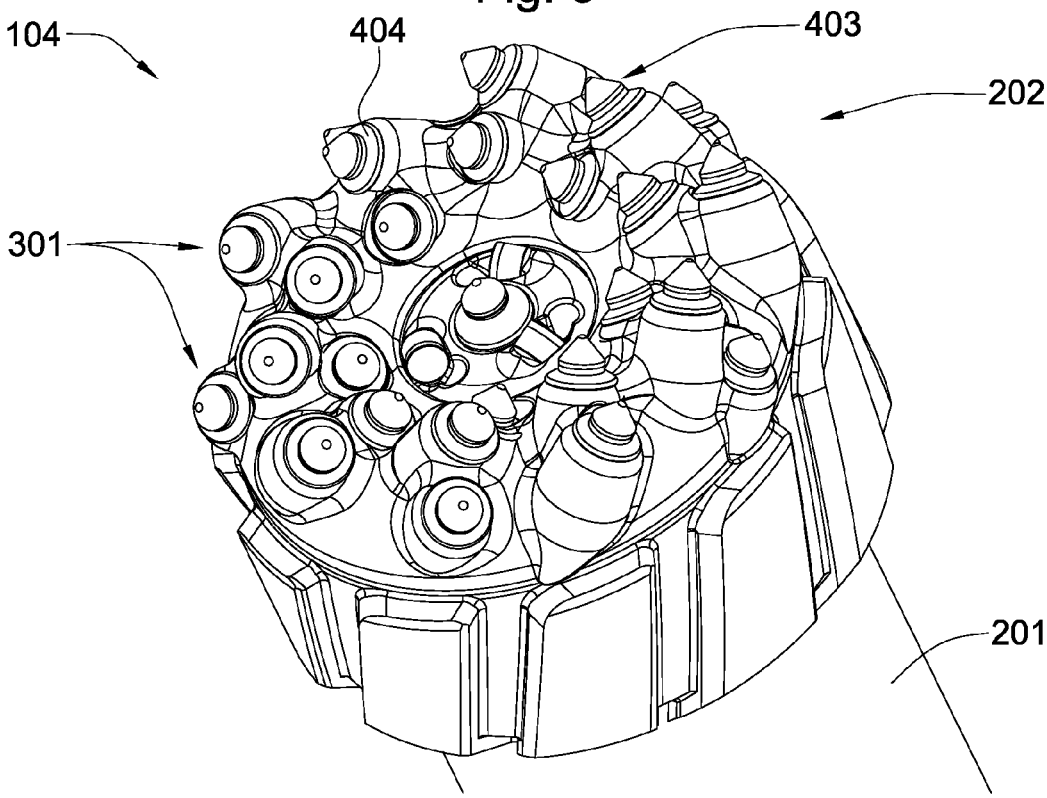
FIG. 9 is a perspective diagram of another embodiment of a rotary drag bit.
Figure 10:
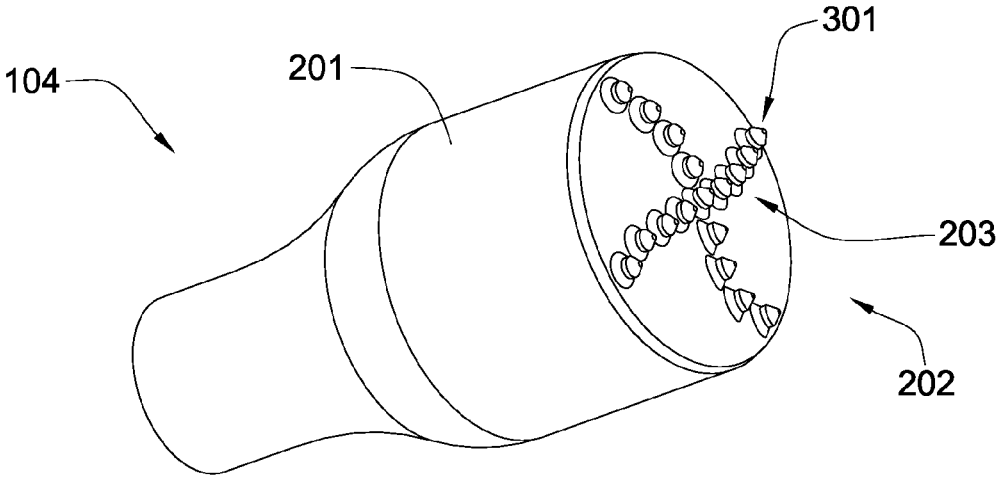
FIG. 10 is a perspective diagram of another embodiment of a rotary drag bit.
Figure 11:
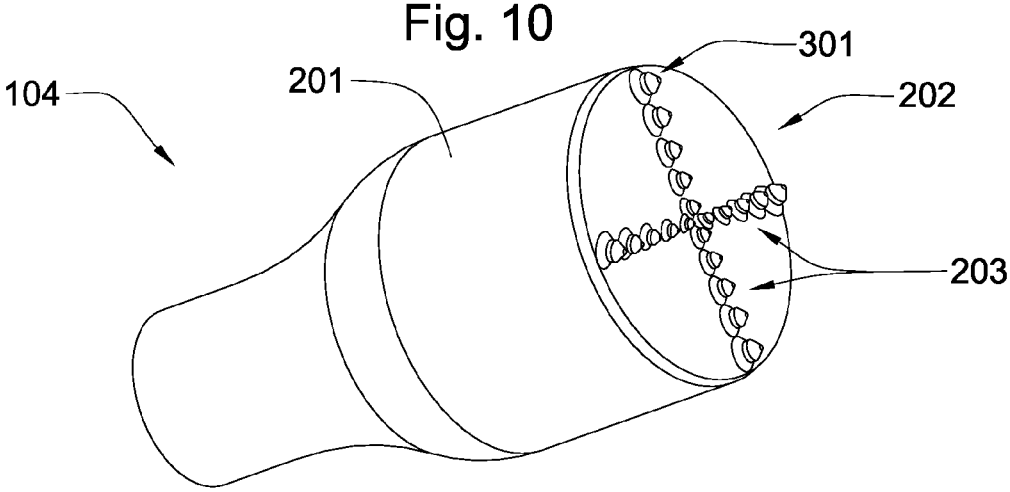
FIG. 11 is a perspective diagram of another embodiment of a rotary drag bit.
Figure 12:
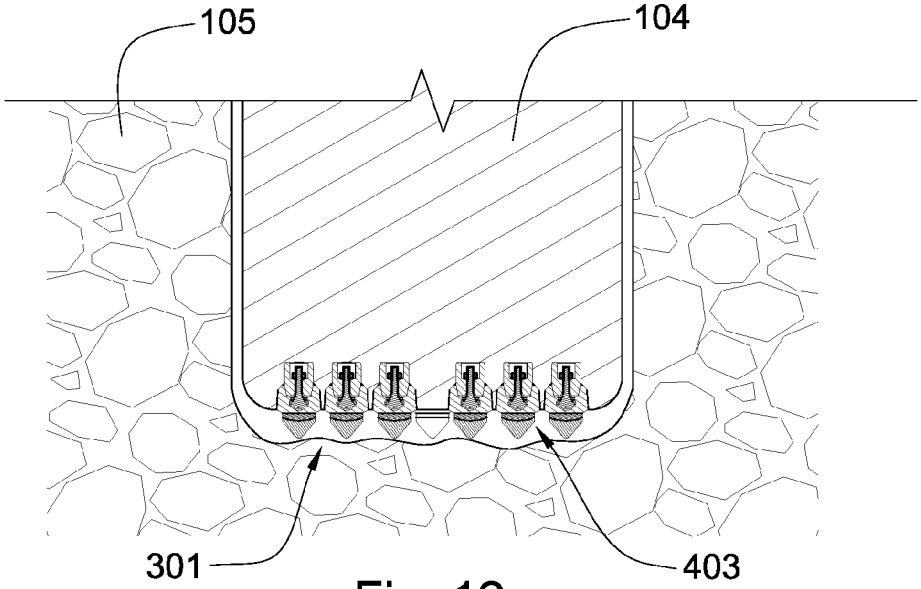
FIG. 12 is a cross-sectional diagram of another embodiment of a rotary drag bit.

FIGS. 8 through 12 disclose various embodiments of the rotary drag bit 104 comprising at least one degradation assembly 301. FIG. 8 discloses a rotary drag bit 104 that may comprise 10 blades 203 formed in the working face 202 of the drill bit 104. The carbide extension 404 may form a portion of the blades 203 and working face 202 of the bit 104. The blades 203 may be formed by the degradation assemblies 301 in the working face 202 of the drill bit 104 such as in the embodiments disclosed in FIGS. 9 through 12. The drill bit may also comprise degradation assemblies 301 of varying sizes.

Figure 13:
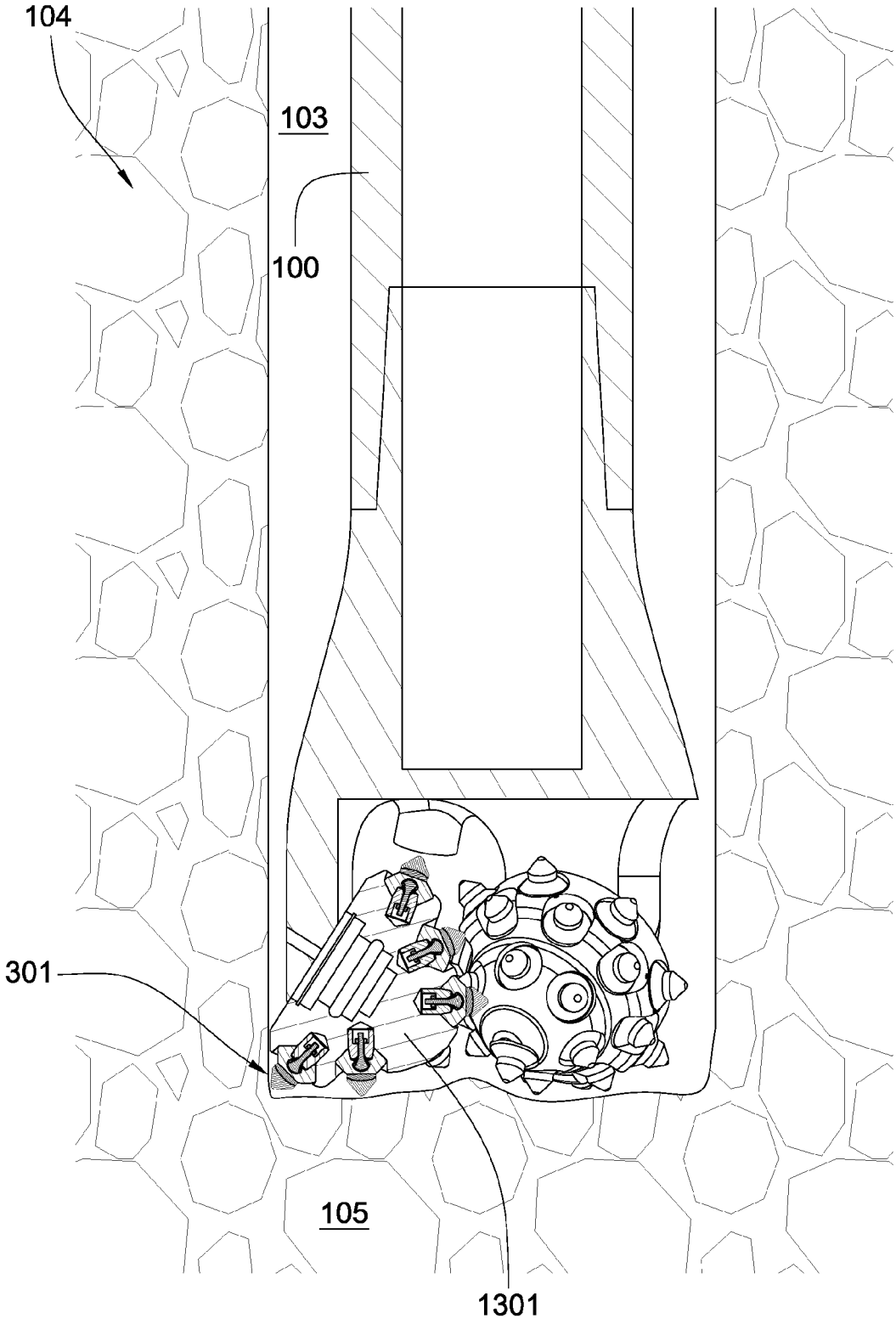
FIG. 13 is a cross-sectional diagram of an embodiment of a roller cone bit.

FIG. 13 discloses an embodiment of the degradation assembly 301 incorporated into a roller cone bit 104. The outer surface 412 of the degradation assembly 301 may be press-fitted into a recess formed in the cone 1301 of the roller cone bit 104. The cone 1301 may comprise multiple degradation assemblies 301.

Figure 14:
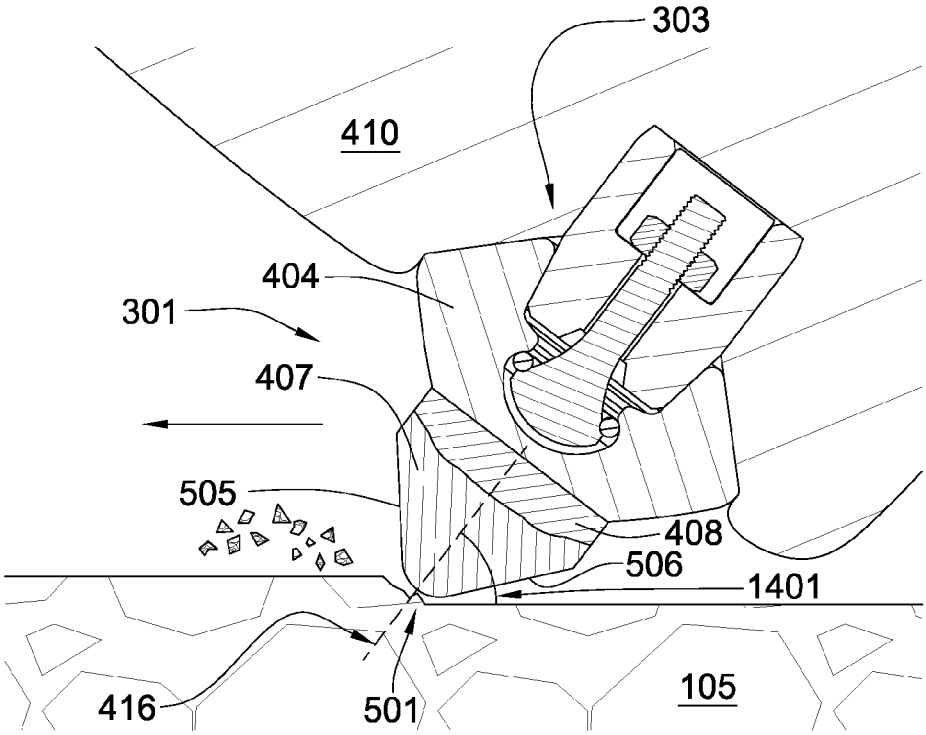
FIG. 14 is a cross-sectional diagram of another embodiment of a degradation assembly.
Figure 15:
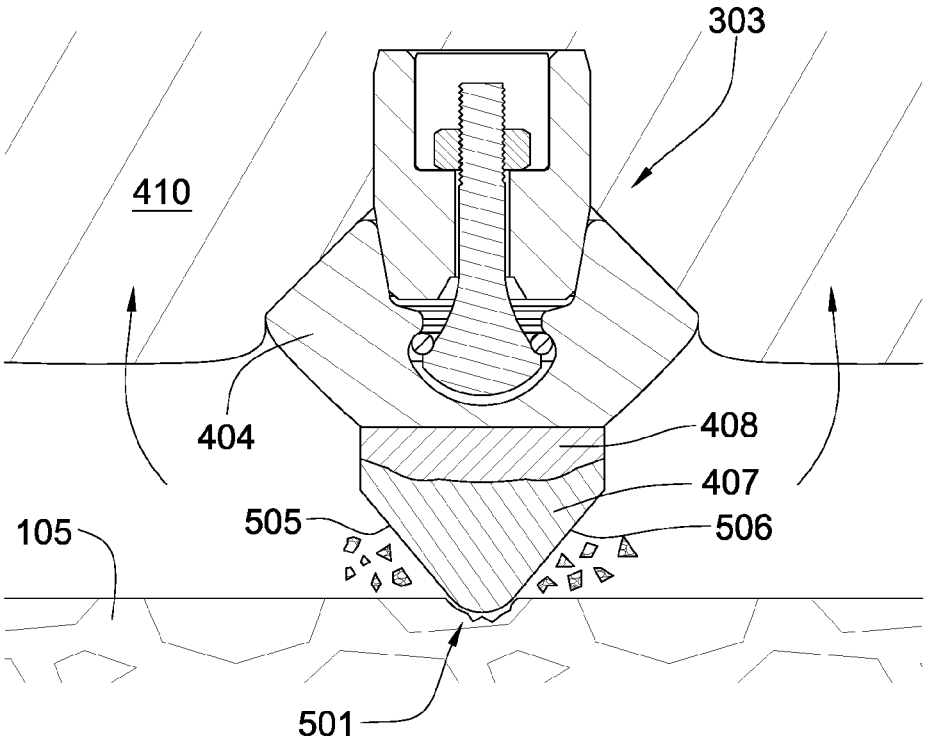
FIG. 15 is a cross-sectional diagram of another embodiment of a degradation assembly.

FIGS. 14 through 15 disclose embodiments of the degradation assembly 301 contacting the formation 105. The degradation assembly 301 may be positioned on the driving mechanism 410 such that apex 501 of the superhard material 407 engages the formation 105 and the sides 505, 506 of the superhard material 407 do not engage or contact the formation 105. The degradation assembly 301 may be positioned on the driving mechanism 410 such that apex 501 of the superhard material 407 engages the formation 105 and no more than 10 percent of the sides 505, 506 of the superhard material 407 engages or contacts the formation 105. It is believed that the working life of the degradation assembly 301 may be increased as contact between the sides 505, 506 of the superhard material 407 and the formation 105 is minimized. FIG. 14 discloses an embodiment of the degradation assembly 301 adapted to a rotary drag drill bit where the apex 501 contacts the formation at an angle 1401 with the central axis 416. The angle 1401 may always be larger than half the included angle 507 discussed in FIG. 5. FIG. 15 discloses an embodiment of the degradation assembly 301 adapted to a roller cone bit.

Figure 16:
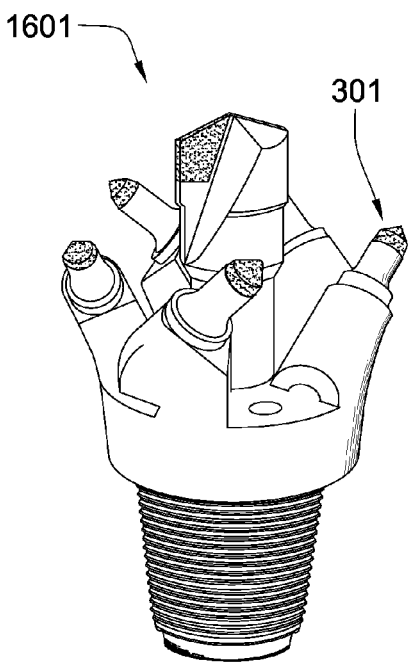
FIG. 16 is a cross-sectional diagram of an embodiment of a drill bit.
Figure 17:
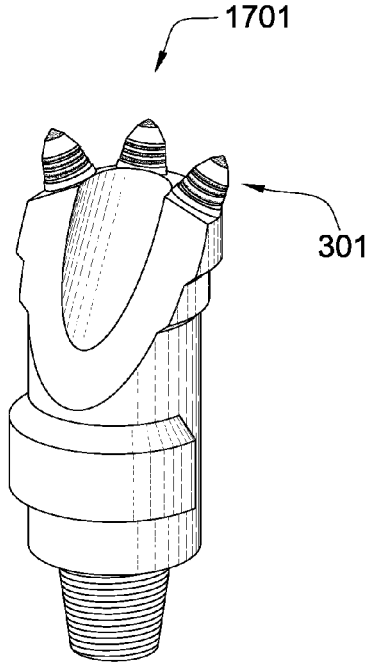
FIG. 17 is a cross-sectional diagram of another embodiment of a drill bit.
Figure 18:
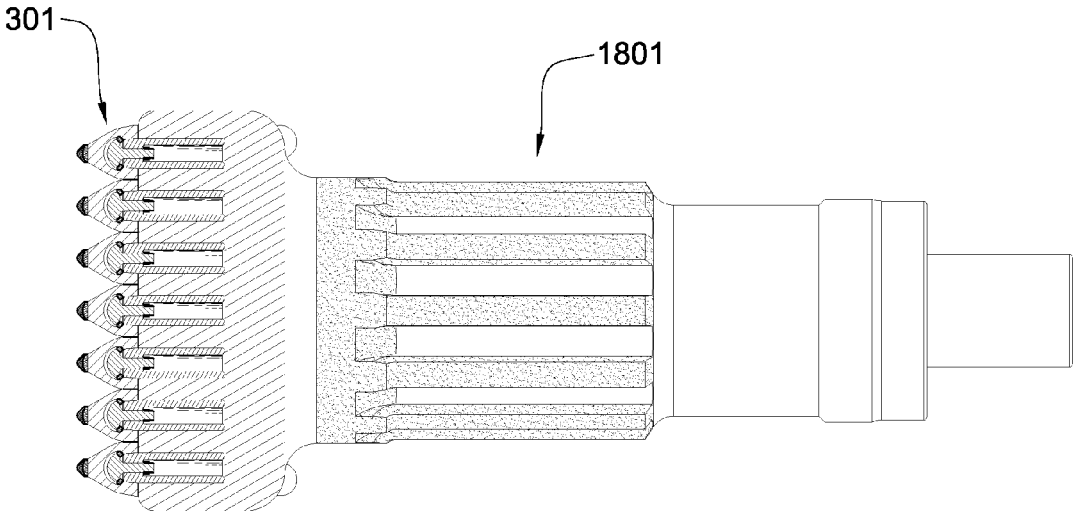
FIG. 18 is a cross-sectional diagram of an embodiment of a percussion bit.

FIGS. 16-18 disclose various wear applications that may be incorporated with the present invention. FIG. 16 discloses a drill bit 1601 typically used in water well drilling. FIG. 17 discloses a drill bit 1701 typically used in subterranean, horizontal drilling. FIG. 18 discloses a percussion bit 1801 typically used in downhole subterranean drilling. These bits 1601, 1701, 1801 and other bits may be consistent with the present invention.

Figure 19:
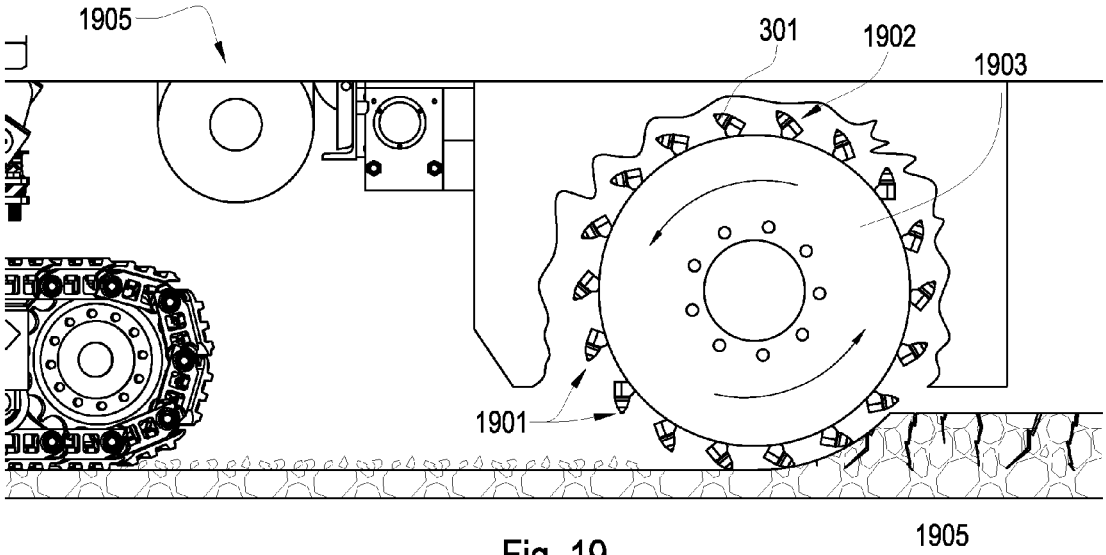
FIG. 19 is a cross-sectional diagram of an embodiment of a milling machine.
Figure 20:
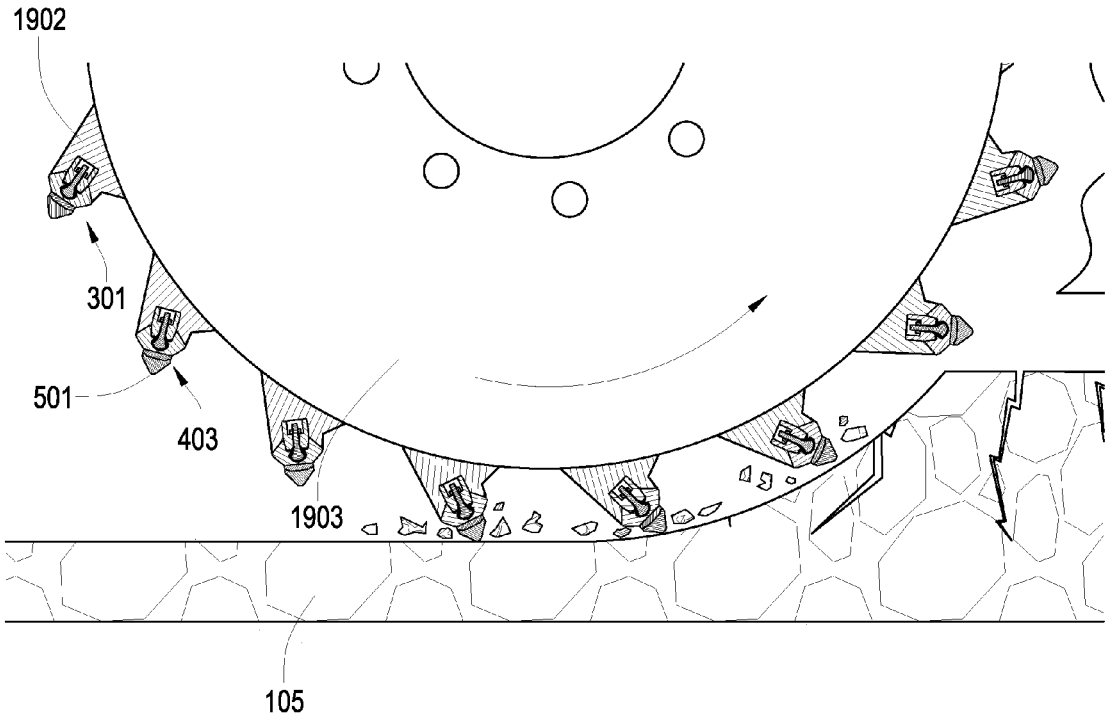
FIG. 20 is a cross-sectional diagram of an embodiment of a milling machine drum.

Referring now to FIGS. 19 through 20, the degradation assembly 301 may be incorporated into a plurality of picks 1901 attached to a rotating drum 1103 that may be connected to the underside of a pavement milling machine 1905. The milling machine 1905 may be a cold planer used to degrade manmade formations such as a paved surface 105 prior to the placement of a new layer of pavement. Picks 1901 may be attached to the driving mechanism 1903 bringing the picks 1901 into engagement with the formation 105. A holder 1902, which may be a block, an extension in the block or a combination thereof, is attached to the driving mechanism 1903, and the pick 1901 is inserted into the holder 1902. The holder 102 may hold the pick 1901 at an angle offset from the direction of rotation, such that the pick 1901 engages the pavement at a preferential angle. Each pick 1901 may be designed for high-impact resistance and long life while milling the paved surface 105. A pick that may be compatible with the present invention is disclosed in U.S. patent application Ser. No. 12/020,924 to Hall and is currently pending. The degradation assembly 301 may also be incorporated in mining picks, trenching picks, excavating picks or combinations thereof.

Whereas the present invention has been described in particular relation to the drawings attached hereto, it should be understood that other and further modifications apart from those shown or suggested herein, may be made within the scope and spirit of the present invention.

What is claimed is:

1. A high impact resistant tool, comprising:

a superhard material bonded to a cemented metal carbide substrate at an non-planar interface;

the superhard material comprises a substantially conical geometry with a apex;

the superhard material comprises a volume greater than a volume of a the cemented metal carbide substrate;

a thickness from the apex to the non-planar interface is at least 1.5 times a thickness of the cemented metal carbide substrate from the non-planar interface to its base and the base end formed a braze interface;

wherein at the interface the substrate comprises a tapered surface starting from a cylindrical rim of the substrate and ending at an elevated flatted central region from in the substrate.

2. The tool of claim 1, wherein the superhard material is diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 20 weight percent, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof.

3. The tool of claim 1, wherein the superhard material comprises infiltrated diamond.

4. The tool of claim 1, wherein the superhard material comprises a metal catalyst concentration of less than 5 percent by volume.

5. The tool of claim 1, wherein the superhard material comprises an average diamond grain size of 1 to 100 microns.

6. The tool of claim 1, wherein the superhard material comprises a volume of 75% to 175% of volume of the carbide substrate.

7. The tool of claim 1, wherein the thickness from the apex to the non- planar interface is 0.190 to 0.290.

8. The tool of claim 1, wherein the superhard material and the substrate comprise a total thickness of 0.200 to 0.500 inches from the apex to a base of the substrate.

9. The tool of claim 1, wherein the apex comprises a radius of 0.650 to 0.950 inches.

10. The tool of claim 1, wherein the tool is incorporated in drill bits, shear bits, percussion bits, roller cone bits or combinations thereof.

11. The tool of claim 1, wherein the substantially conical geometry comprises a first side that forms a 50 to 80 degree included angle with a second side of the substantially conical geometry.

12. The tool of claim 11, wherein the tool comprises an included angle of a total thickness from the apex to a base of the substrate ratio of 160 to 280.

13. The tool of claim 11, wherein the tool comprises an included angle to the thickness from the apex to the non-planar interface ratio of 240 to 440.

14. The tool of claim 1, wherein the superhard material is leached of a catalyzing material to a depth no greater than at least 0.5 mm from a working surface of the superhard material.

15. The tool of claim 1, wherein the depth of at least 0.1 mm from the working surface comprises a catalyzing material concentration of 5 to 0.1 percent by volume.

16. The tool of claim 1, wherein the thickness from the apex to the non-planar interface is at least 2 times a thickness of the cemented metal carbide substrate from the non-planar interface to its base.

17. The tool of claim 1, wherein the superhard material comprises a monolayer of diamond.

18. The tool of claim 1, wherein the flatted central region has a diameter of 0.20 to 0.60 percent of a diamond of the cylindrical rim.

19. The tool of claim 1, wherein the carbide substrate is brazed to an extension.

* * * * *

UNITED STATES PATENT AND TRADEMARK OFFICE

CERTIFICATE OF CORRECTION

PATENT NO. : 7,669,674 B2
APPLICATION NO. : 12/051738
DATED : March 2, 2010
INVENTOR(S) : David R. Hall et al.

It is certified that error appears in the above-identified patent and that said Letters Patent is hereby corrected as shown below:

In the Claims

In column 10, claim 1, line 13, after "substrate at" replace "an" with --a--.

In column 10, claim 1, line 15, after "geometry with" replace "a" with --an--.

In column 10, claim 1, line 17, after "volume of" delete "a".

In column 10, claim 1, line 21, after "the base end" replace "formed" with --forms--.

In column 10, claim 1, line 24, after "central region" replace "from" with --formed--.

In column 10, claim 6, line 45, before "volume of the carbide" insert --a--.

In column 10, claim 7, line 48, after "0.190 to" replace "0.290." with --0.290 inches.--.

In column 12, claim 18, line 4, after "0.60 percent of a" replace "diamond" with --diameter--.

Signed and Sealed this
Eighth Day of May, 2012

David J. Kappos

David J. Kappos
*Director of the United States Patent and Trademark Office*